US005826491A

United States Patent [19]

Steiger

[11] Patent Number: 5,826,491

[45] Date of Patent: Oct. 27, 1998

[54] SEALING ARRANGEMENT ON A PISTON-CYLINDER UNIT

[76] Inventor: Anton Steiger, Hornstrasse 28, CH-8308 Illnau, Switzerland

[21] Appl. No.: 669,503

[22] PCT Filed: Nov. 9, 1995

[86] PCT No.: PCT/CH95/00259

§ 371 Date: Jul. 10, 1996

§ 102(e) Date: Jul. 10, 1996

[87] PCT Pub. No.: WO96/15368

PCT Pub. Date: May 23, 1996

[30] Foreign Application Priority Data

Nov. 14, 1994 [CH] Switzerland ..... 03 392/94

[51] Int. Cl.[6] ..... F01B 3/10

[52] U.S. Cl. ..... 92/155; 92/167; 92/171.1; 92/259; 267/161

[58] Field of Search ..... 92/155, 166, 167, 92/171.1, 259, 248; 267/150, 160, 161

[56] References Cited

U.S. PATENT DOCUMENTS

| | | | |
|---|---|---|---|
| 166,592 | 8/1875 | Duvall | 267/161 |
| 2,856,249 | 10/1958 | Leman | 92/171.1 |
| 2,888,879 | 6/1959 | Gaarder | 92/155 |
| 3,261,598 | 7/1966 | Jones | 267/161 |
| 3,727,900 | 4/1973 | Casey | 267/160 |
| 4,612,256 | 9/1986 | Neuhauser et al. | 428/547 |
| 5,318,412 | 6/1994 | Laskaris et al. | 417/418 |

FOREIGN PATENT DOCUMENTS

| | | |
|---|---|---|
| 0028144 | 6/1981 | European Pat. Off. . |
| 2367959 | 12/1978 | France . |
| 1133856 | 7/1962 | Germany . |
| 2644533 | 4/1977 | Germany . |
| 2265674 | 6/1993 | United Kingdom . |

OTHER PUBLICATIONS

Peckner et al, Handbook of Stainless Steels, McGraw–Hill, Inc., 1977, pp. 2–3, 2–4, TA 479.S7 H28.

Polytechnisch Tijbschrift, vol. 16, pp. 473e to 476e, W. Tebra, Solaris, een op afstand bestuurde onderwater robot.

*Primary Examiner*—F. Daniel Lopez
*Attorney, Agent, or Firm*—Notaro & Michalos PC

[57] ABSTRACT

The device comprises a cylinder (3) and a piston (7) which is guided free of contact relative to the cylinder (3). A gap seal (12) is provided between the lateral surfaces (15, 14) of the cylinder (3) and of the piston (7). The gap seal (12) has a very thin and uniform annular cross section. The lateral surfaces (14, 15) of the cylinder liner (4) and of the piston (7) are essentially smooth and comprise a material with a linear thermal coefficient of expansion which is lower relative to steel. The precise maintenance of the sealing gap and the central guidance of the piston (7) in the cylinder liner (4) is ensured through two guides (8, 9) connected rigidly with the housing (5). These guides (8, 9) are elastic in the direction of the central axis (2) of the piston-cylinder unit and highly rigid transversely to the central axis (2). The arrangement formed with the aid of these guides (8, 9) of a gap sealing between piston (7) and cylinder (3) with minimum gap is free of contact and no abrasion of sealing material develops wherein the motions of the piston (7) are guided precisely centrally to the cylinder (3).

12 Claims, 6 Drawing Sheets

SEALING ARRANGEMENT ON A PISTON-CYLINDER UNIT

FIELD AND BACKGROUND OF THE INVENTION

The invention relates to a sealing arrangement on a piston-cylinder unit with a piston longitudinally movable in a cylinder. The cylinder has a liner extending in the direction of a central axis of the cylinder, with a piston casing and a contact-free gap seal between cylinder liner and piston casing for sealing a liquid or gaseous medium under excess pressure.

Sealing arrangements of this type are used in known manner in compressors, servo motors, measuring pistons or Stirling free-piston motors, which cooperate with a gaseous or, in the case of servo motors or measuring pistons, potentially also liquid medium. Special problems occur wherever the piston-cylinder unit is to be operated free of friction as well as also free of lubricants. This is the case for example with oxygen compressors, or compressors for the food industry. Known compressors of this type include a piston-cylinder unit in which the seal between piston and cylinder is formed by a labyrinth seal. Therein the piston must be guided as centrally as possible in the cylinder in order to avoid contact of the piston casing on the cylinder wall and to prevent corresponding damage or erosion. In order to meet these guidance conditions the piston is provided with a piston rod which is supported and guided in a crosshead. This crosshead is, in turn, driven in known manner via a connecting rod by a rotating crank shaft. In this way, the necessary oscillating motions of the piston are generated wherein the desired guidance of the piston in the cylinder is ensured through the crosshead. Corresponding compressors are described in the technical work "Kolbenverdichter {piston compressors}" by K. H. Küttner, Springer Verlag 1991, pages 236 and in the following. A disadvantage of this implementation resides in that it is not possible to provide very narrow gaps between the piston casing and the cylinder wall but rather a relatively large play is necessary. This is due to the running play of the crosshead guidance, and to the fact that oilfree compressors require a significantly longer construction than oil-lubricated piston compressors. In a long cylinder, the excursions or the deviations of the piston from the central axis become increasingly greater and the free play or the gap between piston and cylinder must therefore be subsequently also correspondingly large. This requires subsequently also the use of labyrinth seals in order to attain the desired sealing between the pressure side of the piston and the pressure-free side. Since during the translational motions in the direction of the central axis the piston cannot be maintained precisely on this axis, the sealing gap between piston casing and cylinder wall does not have an annular cross section but rather the cross section is most often sickle-shaped. The consequence is that the width of the gap on one side can be nearly doubled that on an opposite side and accordingly the sealing tightness in this region is considerably reduced. This asymmetry of the sealing gap leads to considerable problems and is undesirable; however, it cannot be avoided in compressors of this type. The leakage losses in the region of the seal are also correspondly large.

From DE-B 19 33 159 a piston-cylinder unit for a Stirling piston machine is known in which the centering of the piston and the sealing between piston and cylinder is implemented via O-rings. However, this arrangement in practice has only a very short service life, since the seal rings in a lubrication-free operation are very rapidly worn and centering and sealing are no longer ensured. In addition, abrasion particles from the seals become entrained in the circulation of the pressure medium, which normally is not permissible and can also lead to considerable disturbance. Therefore with this solution and for a lubricant-free operation the precise guidance of the piston on the central axis and for long-term operation can not be achieved.

SUMMARY OF THE INVENTION

It is therefore the task of the present invention to describe a seal arrangement in a piston-cylinder unit in which the piston carries out translational motions which are precisely central with respect to the cylinder and in which the piston does not have any outranging motion relative to the central axis of the cylinder; the sealing gap maintains its annular cross section and does not assume the form of a sickle, and the structure can be implemented with minimum size; when mounting the piston-cylinder unit no radial axis displacements between piston and cylinder are caused, i.e. the precise central mounting of all parts is possible; and moreover means are provided to prevent contact of the wall between piston casing and cylinder liner due to thermal expansions.

The guidance of the piston according to the invention ensures the precise guidance of the translational motions of the piston along the central axis of the cylinder and prevents deviating motions at right angles to this central axis. This results in the advantage that between the piston casing and the cylinder wall a minimum seal gap can be set and therefor labyrinth seals become superfluous. Furthermore, the danger does not exist that the cross section of the sealing gap assumes a sickle shape and therefore the capacity to seal of the seal arrangement might be reduced. With a correct positioning of the piston and cylinder the tightness of the piston and a very narrow sealing gap are ensured. By conical centering of the components of the piston and of the cylinder the advantage is obtained that these parts are precisely aligned on the same axis and are retained in this position. This ensures that the piston and the cylinder during motion do not come into contact at any place and the annular gap during the entire operation stays constant. The connection of the cylinder with the machine housing also takes place via a conical centering or via several elastic mountings. At least three mountings are fastened on the housing and are used with elastic tongues via a lateral surface of a housing part of the cylinder. This sets the radial positioning and thus centering of the cylinder. In the unassembled state of cylinder and housing the mounting surfaces on the elastic tongues define an inner diameter which is smaller than the outer diameter of the surface area on the housing part of the cylinder. This results in the advantage of a radial/play-free reception and mounting of the cylinder relative to the housing. The lateral surface on which the elastic mountings are in contact, can be implemented as outer surface or as inner surface and the mounting surfaces on the mountings are directed accordingly inwardly or outwardly. A further advantage of the arrangement resides in that the parts of the piston and of the cylinder, namely the piston casing and the cylinder liner, which form the boundary faces of the gap seal, comprise a material which has a very low coefficient of thermal expansion. Such materials are known per se and in the present case high-nickel steel or sintered graphite or carbon are chosen. As much as possible the various parts have identical thermal expansions at the same temperatures wherein the linear coefficient of thermal expansion should be smaller at least by a factor 4 than that of nonalloyed steel or iron. This ensures that temperature differences between the piston and cylinder cause practically no additional changes of the sealing gap.

By using graphite on at least one of the parts of the piston or the cylinder which form the boundary faces of the gap seal, additional assurance against damage of the sealing faces in the event of a disturbance is achieved. Such disturbance could occur if through external influences, such as lateral impacts or earthquakes any deviations of the axis occur. In this case, rather than an eroding of the parts that contact each other, sintered graphite or a nickel-graphite coating would be ground off. This yields the advantage that after a period of running-in, the seal gap would be set automatically and the piston-cylinder device could be operated normally. This type of implementation has the further advantage that the piston and cylinder are practically assembled at the beginning with a form fit and through corresponding running-in the sintered graphite, or the nickel-graphite coating, i.e. of the piston casing or the cylinder liner, this part is honed in, and the sealing gap is formed through the running-in operation. This option can be used if minimum sealing gaps are desired and the correspondingly high costs for the running-in and subsequent removal of the abraded material can be accepted. Instead of sintered graphite or coatings of nickel-graphite, other materials can also be used which have the same thermal properties and the same emergency running properties. However, the listed materials have been found to be particularly suitable.

So that even under thermal loading of the components of the piston and of the cylinder during the operation, and longitudinal changes potentially resulting therefrom, no deviations of the piston and of the cylinder from the central axis are possible, the individual components are joined using elastic clamping elements which act in the direction of the axis of the conical centering or the central axis. Through the cooperation of the conical centering and the tension forces, the advantage is attained that even with temperature differences between the components in the radial direction no additional play is caused since the components in the conical guides always remain pressed one to the other in the axial direction. This ensures the maintenance of the concentricity between piston and cylinder.

In the seal arrangement according to the invention each of the two guides disposed at a distance with respect to one another is comprised of several plate-shaped spring elements. The suggested arrangement of the guides with the spring elements has the advantage that the piston which carries out oscillating linear motions is centered and guided precisely on its central axis. The guides do not comprise any parts which move against each other and are subject to sliding friction. The piston is guided and centered through the two guides so that it can carry out a purely axial relative motion, free of contact relative to the cylinder and do so for example in a lubricant-free oxygen compressor or a lubricant-free piston of a Stirling free-piston motor. The spring elements of the individual guides are disposed in a plane which is at approximately right angles to the central axis of the oscillatingly moved machine element. The main spring parts which are implemented in the form of plates are in this plane. This arrangement of the main spring parts allows calculating the motions and spring data in known manner so that the motions of the machine element can also be determined accurately. In the outer regions of the long main spring parts, shorter auxiliary spring parts are disposed and specifically at right angles to the main spring parts so that these auxiliary spring parts extend approximately parallel to the central axis. The connection of the auxiliary spring parts with the main spring parts takes place via an additional connection element which is equipped with corresponding fastening means for the secure connection of the ends of the main and auxiliary spring parts. Providing this additional connection element between each auxiliary spring part and the associated main spring part results in the advantage that the spring element in the bent-over region is rigid and the deformations of the spring elements take place only in the plate-shaped regions. The individual auxiliary spring parts and main spring parts as well as the connection elements can be fabricated very precisely according to technical specification so that after installation they have the desired values with respect to dimensional accuracy as well as also stability values. This precise agreement with specified dimensions and stability values can be achieved with conventional production methods since the spring parts and the connection elements have simple forms. The individual components can, moreover, be tested in simple manner and parts deviating from the standard data can be readily eliminated. The assembly of each spring element from several discrete spring parts permits adaptation to different requirements and entails the considerable advantage that no parts of the spring elements must be deformed, for example bent over, during production. The plate-shaped implementation of the discrete spring element parts permits precise working to the desired dimensions, for example by grinding, at any time. In the normal case, the main and the auxiliary spring parts are planar plates.

The plate-shaped spring elements of each guide are positioned to be symmetrical with respect to the center so that, from the central axis in the plane of the guide, four, six or more spring element parts extend radially outwardly. Odd numbers of spring element parts in the plane of the guide are possible, however each spring element comprises one main spring part which extends symmetrically on both sides of the central axis. In this way identical angles are formed between the spring elements which are disposed in one plane. This has the advantage that the machine element is centered exactly symmetrically on the central axis.

The dimensions of the long main spring parts and the short auxiliary spring parts are selected in known manner so that the rigidity of the two guides which guide the piston is transversely to the central axis, greater by at least a factor of 100 than transversely to the central axis. Depending on the desired guidance precision in the region of the seal gap and the occurring transverse forces, guides with a rigidity ratio of more than 500 are used. In the arrangement according to the invention further advantages result in that the absorption of force and the rigidity or the motion can be changed by adapting discrete spring element parts. The rigidity ratio can be changed for example not only by changing the dimensions of the plate-shaped spring parts but also in that at least two auxiliary spring parts or main spring parts are spaced at a distance and parallel with respect to each other or that auxiliary as well as main spring parts are implemented in such manner. If no change of the spring constants is desired, in a guide in two planes disposed at a distance, two groups of plate-shaped spring elements can be used. This leads to an increase in the bearing capacity of the corresponding guide at approximately constant rigidity ratios. In all of these differing arrangements and embodiments, the same basic elements of the main spring parts, auxiliary spring parts and connection elements can always be used so that the bases for calculations are simplified and also the fabrication of the discrete parts is made considerably easier. A further advantage is realized in that the main spring part of the discrete spring elements can be integral or in two parts. If the guide is disposed at the end of an axis element, it can be of advantageous to implement the main spring parts integrally since they subsequently can be connected to the axis element with the aid of a central connection element. However, if the guide is disposed anywhere in the axis region of the machine element, it if often useful to make the main spring parts in two pieces and subsequently to connect the inner ends to the axis element directed toward the central axis, using corresponding fastening devices.

With the claimed combination of elements which form the seal arrangement according to the invention, pistons can be guided so precisely in a cylinder that lubricant-free operation is made possible, and yet sealing gaps between piston and cylinder of minimum dimensions are possible. By using two identical guides spaced at a distance from each other, the piston is guided precisely along the central axis, and disturbing motion deviations are avoided. It becomes possible for example to guide the piston or the piston rod of a free-piston motor, for example a Stirling motor, in the cylinder without using lubricants for the working piston or the displacer piston. Contamination of the pressure medium by abraded material or lubricant residues is completely avoided. The same applies also to oxygen compressor or to compressors with other pressure media, which must not be contaminated with lubricant or abraded material. The seal arrangement according to the invention does not require lubricants and also ensures that during operation no abraded material is generated in the region of the sealing gap.

BRIEF DESCRIPTION OF THE DRAWINGS

In the following the invention will be explained in further detail with the aid of drawings representing embodiments of the invention. In the drawings.

DESCRIPTION OF THE PREFERRED EMBODIMENTS

Figure 1:
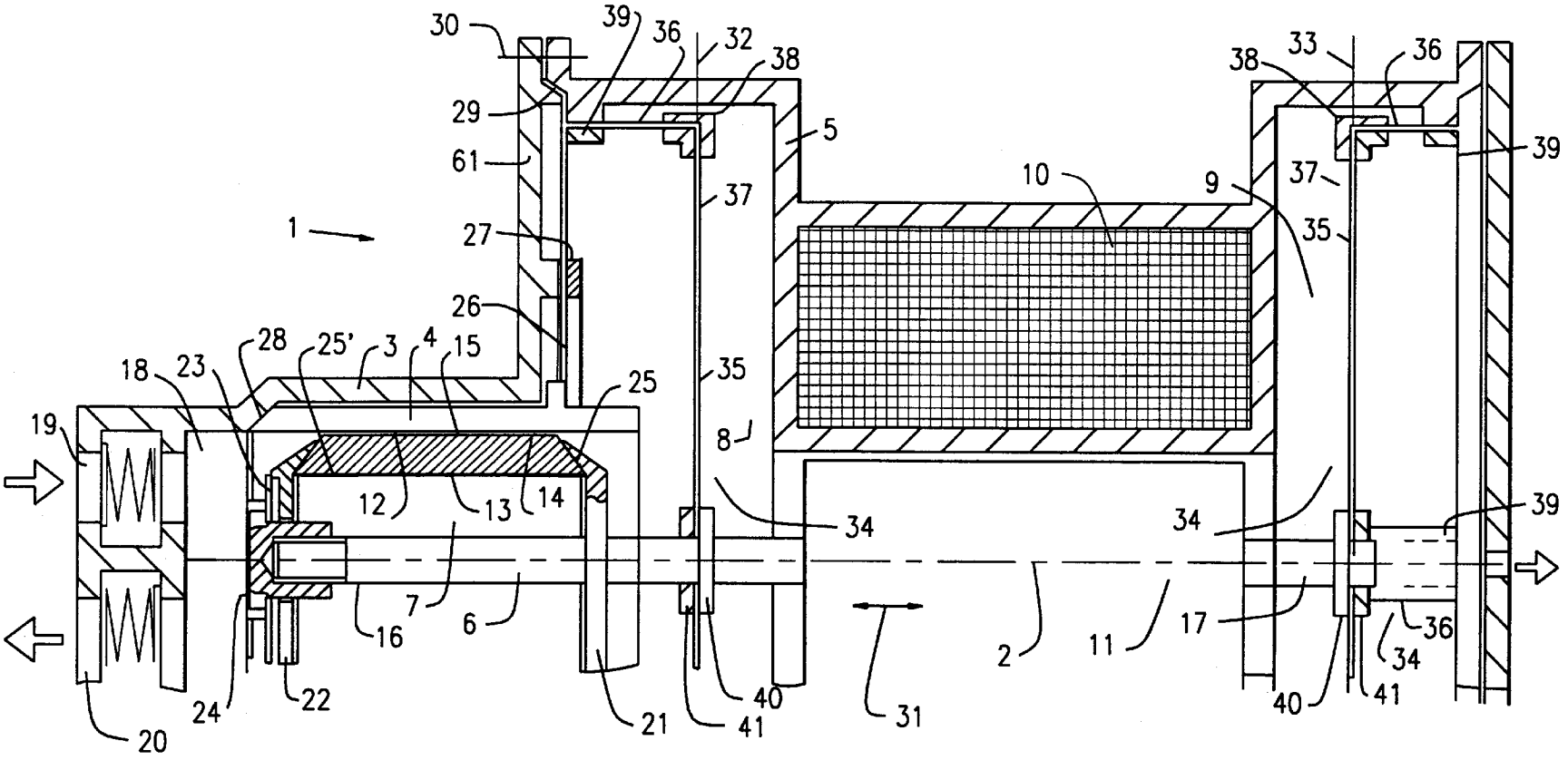
FIG. 1 is a longitudinal section through a compressor represented schematically, with electromagnetic drive.

FIG. 1 is a longitudinal section through a compressor 1, wherein only the upper portion is shown; however, the lower portion is identical and symmetrical with respect to the center. The compressor 1 comprises a housing 5, an electric drive which comprises a stationary magnetic coil 10 and a longitudinally movable armature 11 in the housing. The armature 11 is connected to a piston rod 6 and piston rod 6 and armature 11 have a common central axis 2 and are translationally movable in the direction of this central axis 2. The piston rod 6 is supported on two guides 8 and 9 and guided precisely and centrally therein. The two guides 8 and 9 are disposed at a distance with respect to each other. At the front end 16 of the piston rod 6 a piston 7 with a piston casing 13 is fastened.

This piston 7 is encompassed by a cylinder liner 4 which is a component part of a cylinder 3. The cylinder 3 is, in turn, connected to the housing 5 and forms a portion of the same. Cylinder 3 defines a working volume 18 for the pressure medium and comprises in known manner inlet valves 19 and outlet valves 20. Between the piston casing 13 and the cylinder liner 4 a gap seal 12 is realized wherein the piston 7 is guided free of contact in the cylinder liner 4. This implementation of a contact-free gap sealing is made possible through the implementation and arrangement of the two guides 8, 9. In the example shown it is for example possible to realize on the gap sealing a gap width of 0.01 mm at a piston diameter of 45 mm.

The piston 7 is composed of several parts. The piston rod 6 comprises a plate-shaped flange 21 which forms the mounting for the cylindrical piston casing 13. A second plate-shaped flange 22 cooperates with the other end of the piston casing 13 and is connected to the front end 16 of the piston rod 6 via an elastic clamping element 23 and a tension nut 24. The two plate-shaped flanges 21, 22 comprise conical margin regions 25 or 25', respectively. The two end faces of the piston casing 13 are also conical. The conical margin region 25 of the plate-shaped flange 21 centers and guides the piston casing 13 precisely centrally to the central axis 2. The elastic clamping element 23 generates a continuous tension force in the direction of the central axis 2 and ensures that even with longitudinal changes due to temperature changes the piston casing 13 is always clamped precisely centrally between the two plate-shaped flanges 21, 22. The elastic clamping element 23 comprises a plate spring. The piston casing 13 in the example shown is produced of sintered graphite and the clamping between the two conical margin regions 25 and 25' of the plate-shaped flange 21, 22 ensures a permanent pressure prestress and secure mounting for the sinter body 13. The materials used for the piston casing 13 and the cylinder liner 4 have a linear thermal coefficient of expansion which is at least four times smaller than that of nonalloyed steel wherein the latter is $11.1\times10-6$ per degree Kelvin. A high-alloy nickel steel with for example 36% nickel can have a linear coefficient of expansion of $0.9\times10-6$ per degree Kelvin.

The cylinder liner 4 is supported and centered, on the one hand, via an elastic clamping element 26 and fastening element 27, and, on the other hand, via a conical centering surface 28 in cylinder 3. The elastic clamping element 26 also comprises a disk spring; however, it can also be formed of other known elastic elements. In the event of longitudinal changes of the cylinder liner 4 due to temperature differences the cylinder liner is always pressed in the direction of the central axis against the conical centering surface 28. This ensures that the cylinder liner is always centered and free of play and no deviations relative to the central axis 2 occur.

In order to ensure the orientation of cylinder 3 and cylinder liner 4 on the central axis 2, a conical centering surface 29 is formed on the housing part 61 of the cylinder 3, between cylinder 3 and housing 5. The connection between cylinder 3 and housing 5 takes place via connection elements 30, shown schematically, in the region of the conical centering surface 29. Since, in the case of conical centering surface 29, the housing 5 as well as the cylinder 3 comprise the same material, no thermally caused axial motions need be expected. The conical centerings between the individual parts of cylinder 3 and of piston 7 ensure that the individual parts are combined precisely centrally to the central axis 2 and therewith form the prerequisites for forming the desired minimum gap at the gap seal 12.

The two guides 8 and 9 center and guide the piston rod 6, or piston 7, so that the lateral surface 14 of the piston casing 13 extends free of contact and exactly parallel to the cylinder surface 15 of the cylinder liner 4. This takes place over the entire length of the translational motions of piston 7 in the direction of arrow 31. The first guide 8 is disposed in the immediate proximity of piston 7 and the second guide 9 at the rear end 17 of piston rod 6. These guides 8, 9 are oriented on two planes 32, 33 which are approximately at right angles to the central axis 2. The two planes 32, 33 and therewith the two guides 8, 9, are disposed in the direction of the central axis 2 spaced at a distance from each other. This distance is determined by the bearing conditions as well as the constructional conditions of the compressor.

Figure 3:
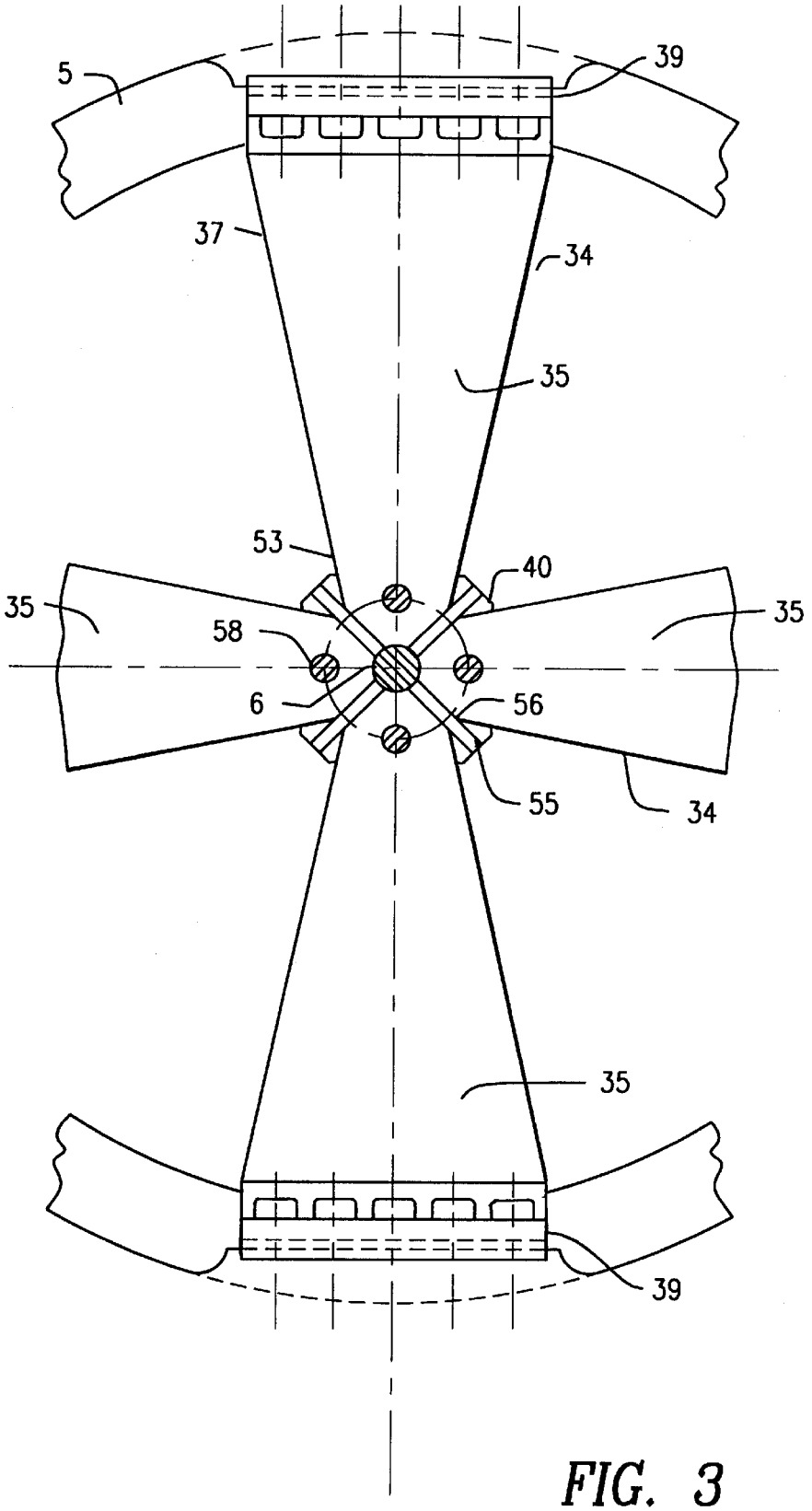
FIG. 3 is a partial front view of one of the guides for the piston depicted in FIGS. 1 and 2.

Each of the two guides 8, 9 comprises several spring elements 34, which is most readily recognizable in FIG. 3. Each of these spring elements 34 comprises a two-part long main spring part 35 as well as two short auxiliary spring parts 36 rigidly fastened at the outer ends 37 of the main spring parts 35 and connected with housing 5. The auxiliary spring parts 36 are disposed at approximately right angles to the main spring part 35 and consequently extend approximately parallel to the central axis 2. The rigid connection between the outer ends 37 of the main spring part 35 and the auxiliary spring parts 36 is established by means of connection elements 38. The spring elements 34 are firmly connected, on the one hand, via the auxiliary spring parts 36 and fastening elements 39 with housing 5, and, on the other hand, fixedly connected via the main spring parts 35 as well as the flange 40 and clamping element 41 with the oscillatingly moved piston rod 6 and the piston 7. The two guides 8, 9 are implemented precisely identically, however as is evident in FIG. 1, are disposed mirror symmetrically inverted to each other. The guiding and centering of piston 7 is therein so precise that between piston 7 and cylinder liner 4 only a very narrow gap 12 is necessary. The sealing of the piston volume 18 can thus take place through a contact-free gap sealing 12, and no seals are necessary and present which might be abraded or worn through relative motions. The spring system formed by the spring elements 34 of each guide 8, 9 is implemented so that the rigidity in the direction of planes 32, 33 is at least greater by a factor of 100 than its rigidity in the direction of the central axis 2. In the example shown in FIG. 1 the rigidity transversely to the central axis 2 is approximately 200 times greater than in the direction of the central axis 2. To this end spring parts of hardened spring steel are used with a thickness of 1.18 mm. For each guide 8, 9 two spring elements 34 are available which are disposed at right angles with respect to each other and which each comprise two main spring parts 35 and two auxiliary spring parts 36. The main spring parts 35 have a length of approximately 13 cm and the auxiliary spring parts a length of approximately 2.2 cm. Therewith a piston stroke of 20 mm becomes possible. The piston diameter is 45 mm and the oscillation frequency is 50 oscillations per second.

Figure 2:
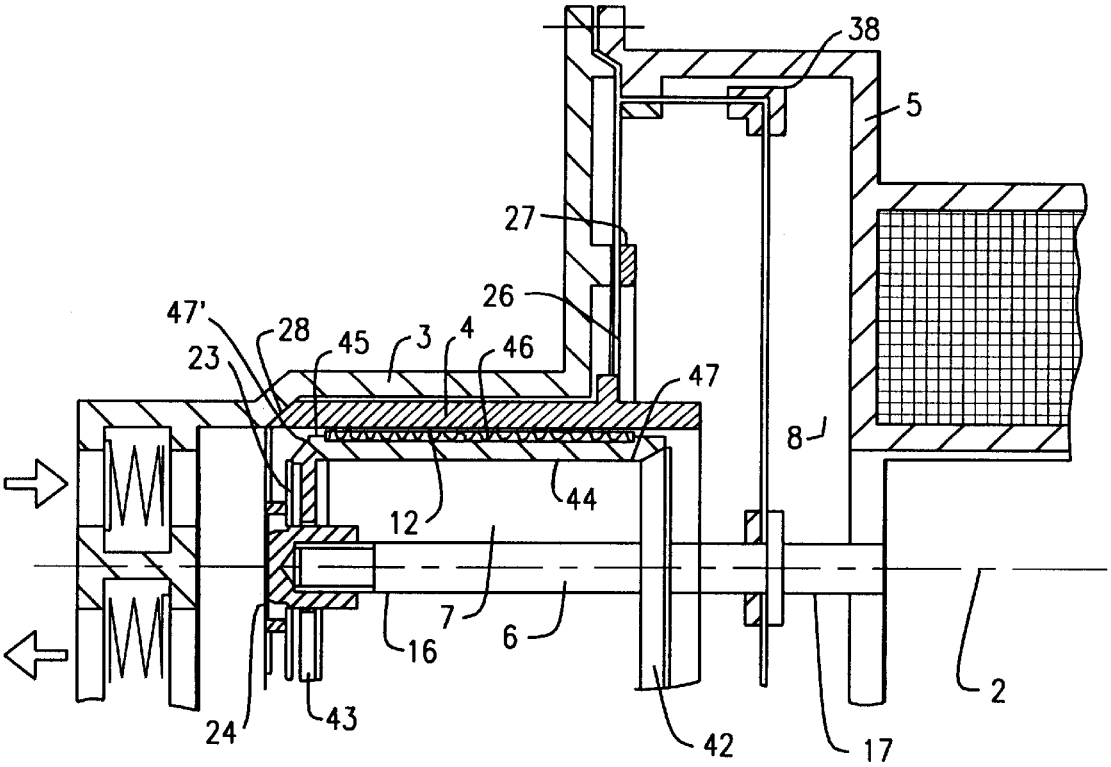
FIG. 2 is a longitudinal section through the piston-cylinder region of the compressor according to FIG. 1, with a coated piston.

FIG. 2 shows another embodiment of piston 7 wherein the remaining parts of compressor 1 are formed identically to FIG. 1. In cylinder 3, again, a cylinder liner 4 is emplaced which is produced of a high-nickel steel, in the example shown of type 36% Ni alloy. Centering and clamping in of cylinder liner 4 in cylinder 3 here also takes place via the conical centering surface 28, and the elastic clamping element 26 and the fastening elements 27. The piston 7 also comprises several parts. A piston casing 44 is clamped between a plate-shaped flange 42 extending from the piston rod 6, and a second plate-shaped flange 43. The clamping force is generated by the elastic tension element 23 in the form of a disk spring, and the tension nut 24. The tension nut 24 is screwed onto the front end 16 of the piston rod 6. The piston casing 44 comprises high-nickel steel. On the lateral surface 45 of this piston casing 44 a coating 46 of suitable nickel-graphite is applied, for example in the composition of 15–25 percent by weight graphite and 75–85% nickel. This coating 46 forms the boundary face of the gap seal 12 against the cylinder liner 4. The conical margin regions 47 or 47' at both ends of the cylindrical piston casing 44 here have a slope which with respect to the piston casing 44 effects a tension prestress. This is permissible and advantageous due to the selected material, steel.

In the embodiment of piston 7 according to FIG. 1 as well as also according to FIG. 2, the dimensions of the piston casing 13 or 44 and the cylinder liner 4 are at the very outset selected so that when assembling the components a gap of minimum width is formed in the region of the gap seal 12. In the case of sealing arrangements between piston 7 and the cylinder liner 3, in which a highly uniform annular cross section is required, and simultaneously the thickness of the gap of the gap seal 12 is to be absolutely minimum, it is possible to select the diameter of the piston casing 44 and of the cylinder liner 4 so that nearly a form fit or a relatively exacting sliding seat is generated. Through careful running-in the sintered graphite material of the piston casing 13, or the coating 46 on the piston casing 44 can be abraded and thereby a very narrow gap seal 12 can be generated. It is also possible to exchange the material combination between cylinder liner 4 and piston casing 13. The precise guidance of piston 7 via guides 8 and 9 as well as the conical centerings of the various parts of piston 7 and of cylinder 3 permit in any case the implementation of a very narrow and contact-free gap seal 12, and therewith the lubricant-free operation. Since piston 7 in normal operation runs free of contact in the cylinder liner 4, no abrasion is generated which also prevents the contamination of the pressure medium.

FIG. 3 shows a guide 8, 9 as is used in FIG. 1 or 2, as partial view in the direction of the central axis 2. It is evident that in each of planes 32 or 33 two spring elements 34 are disposed wherein between the spring elements 34, seen in the circumferential direction, identical angles are formed. Each of the spring elements 34 comprises two main spring parts 35, two auxiliary spring parts 36 and two connection elements 38. The ends facing away from the connection elements 38 of the short auxiliary spring parts 36 are rigidly fastened on the housing 5 of compressor 1 by means of fastening elements 39. The piston rod 6 moved axially oscillatingly comprises a flange 40 as well as a clamping element 41 which serves for connecting the inner ends 53 of the main spring parts 35 to the flange 40. The short auxiliary spring parts 36 are formed of flat rectangular plates. The main spring parts 35 are trapezoidal and toward the outer end 37 are wider than at the inner end 53. The form of the spring parts 35, 36 is in known manner determined by the desired spring characteristics. On the flange 40 ribs 55 are disposed which form stop faces 56 for the inner ends 53 of the main spring parts 35. Through these ribs 55 and the corresponding stop faces 56 as well as the corresponding forming of the inner ends 53 of the main spring parts 35, their position relative to the piston rod 6 is precisely determined. In this position the inner ends 53 of the main spring parts 35 are clamped in and secured with the aid of the clamping element 41 and screws 58.

Figure 4:
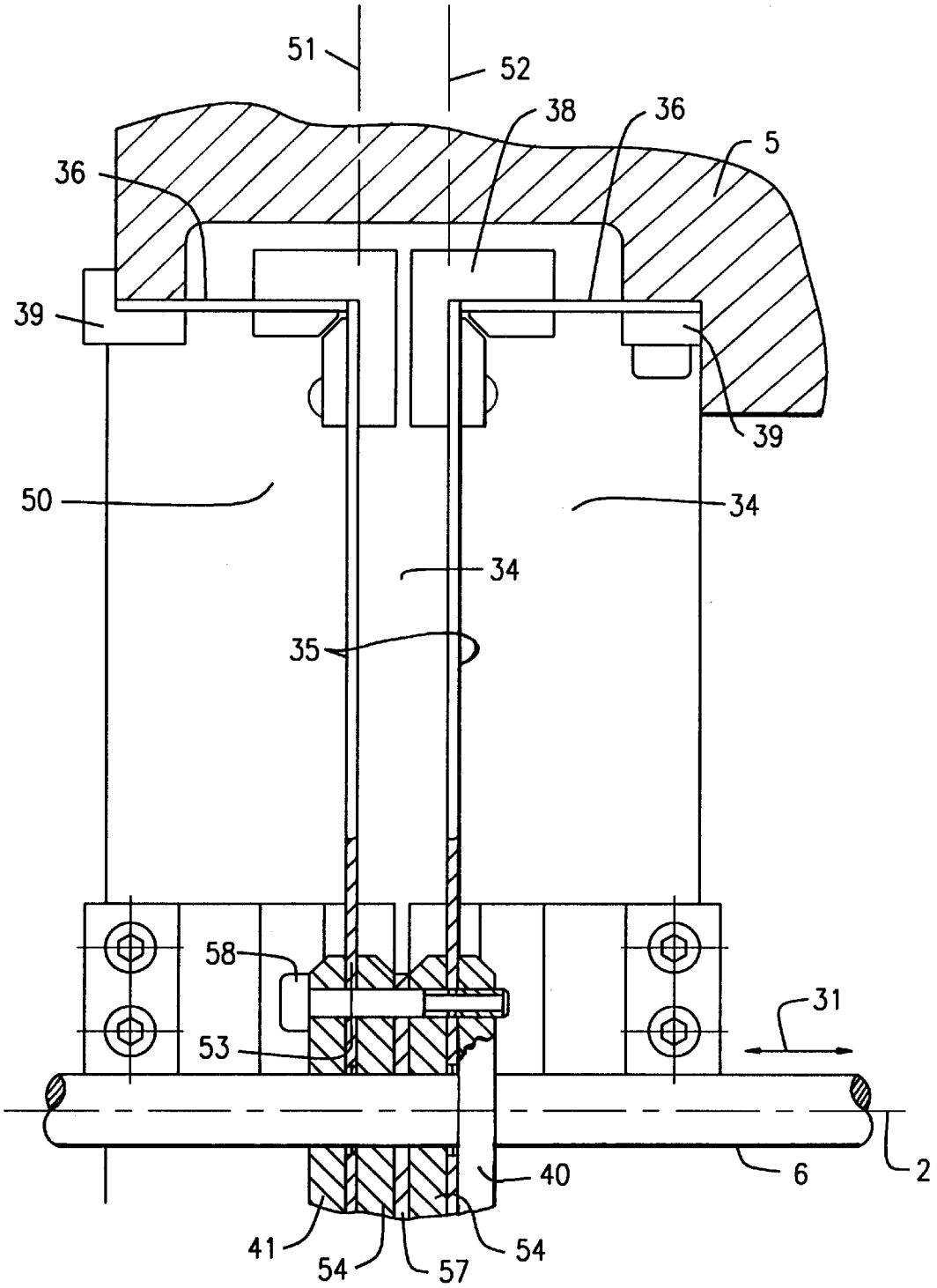
FIG. 4 is a detail from a guide with double spring elements and two-part main spring parts.

FIG. 4 shows a guide 50 which corresponds in principle to the arrangements according to FIGS. 1 and 2. However, at each guide 50 two planes 51, 52 are present spaced at a distance from each other, in each of which spring elements 34 are disposed. The two planes 51, 52 extend parallel with respect to each other and approximately at right angles to the central axis 2 of the piston rod 6. As described and shown in connection with FIG. 3 here also in each of the planes 51, 52 two spring elements 34 are disposed between which spring elements 34, seen in the circumferential direction, identical angles are formed. In addition to flange 40 and clamping element 41 here on the piston rod 6 two centering plates 54 and a spacer disk 57 are disposed. The centering plates 54 comprise the ribs 55 with the stop faces 56. The inner ends 53 of the spring parts 35 disposed in pairs are clamped in between one centering plate 54 and flange 40, or the clamping element 41. The tension force is generated by means of screws 58. This arrangement depicted in FIG. 4 of a guide 50 with two spring planes 51, 52 can absorb relatively large longitudinal and transverse forces. But for the remainder it permits the same motion runout as the simple embodiment shown and described in FIG. 1. In particular the freedom of the linear oscillating motion of the piston rod 6 and the associated piston 7 in the direction of arrows 31 is ensured. The embodiment described according to FIGS. 3 and 4 using two-part main spring parts 35 is particular useful wherever further machine elements are disposed on axis 2 behind guide 50, which do not permit placing continuous integral spring elements 34 on the piston rod 6. But, furthermore, the production of the main spring parts 35 is facilitated since they have smaller dimensions and, if necessary, individual parts of a spring element 34 can also be exchanged. But it is entirely possible and within the scope of the invention to use for example in plane 33 in FIG. 1 an integral main spring part 35. These have a central bore and can be slid onto the piston rod 6 and subsequently be clamped securely.

Figure 5:
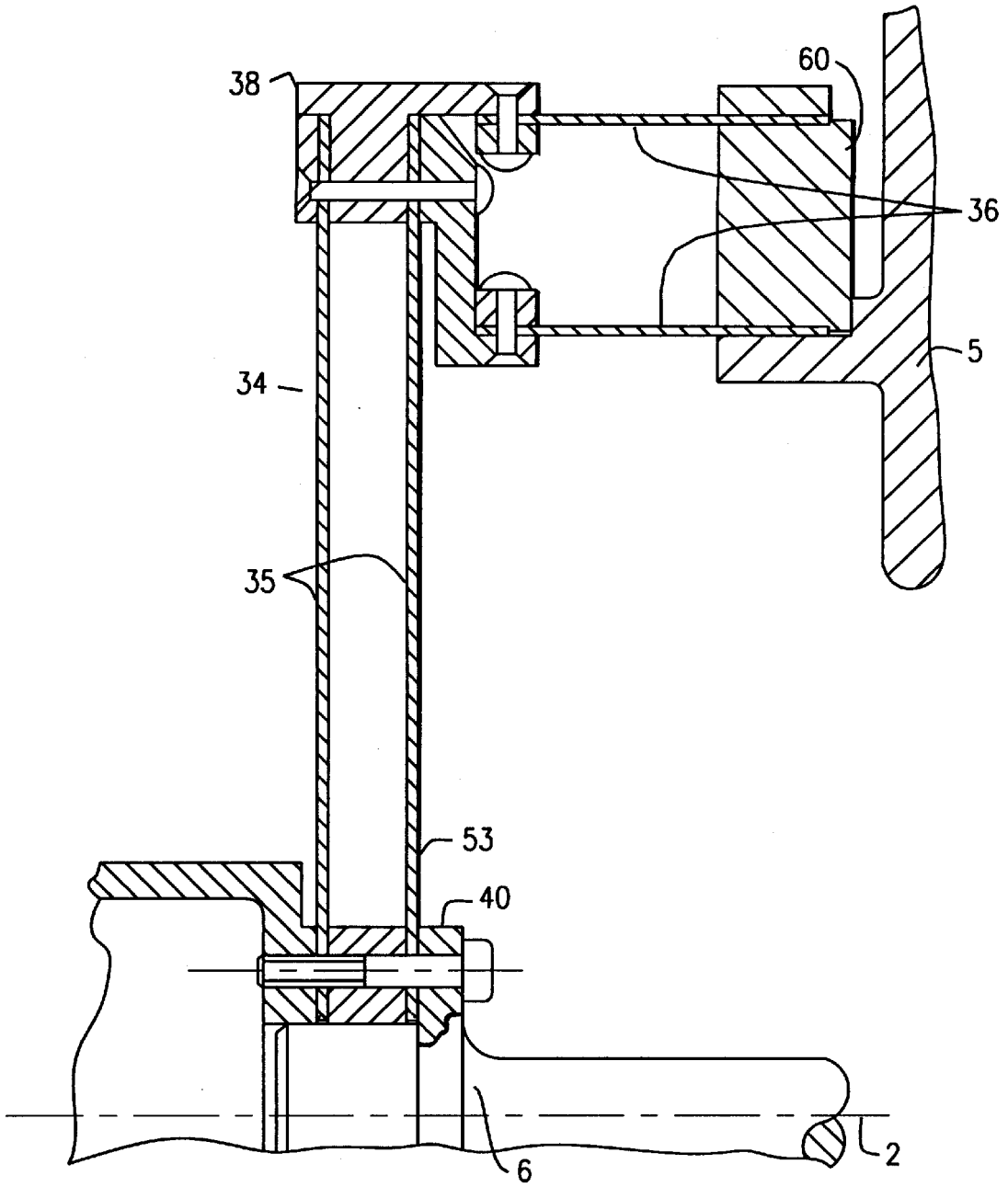
FIG. 5 is a detail from a guide with two-part main spring parts and main and auxiliary spring parts disposed in pairs.

In FIG. 5 a further embodiment of a guide according to the invention for a sealing arrangement is depicted, wherein in each spring element 34 the main spring parts 35 as well as also the auxiliary spring parts 36 are disposed in pairs parallel and at a distance with respect to one another. The connection of the inner ends 53 of the main spring parts 35 with the flange 40 of piston rod 6 takes place in the same way as has been described in connection with FIG. 3 or 4. The connection element 38 between the outer ends of the main spring parts 35 and the ends abutting thereon of the main spring parts 35 is correspondingly implemented and comprises support faces for the pairwise arrangement of the parallel springs. To connect the auxiliary spring parts 36 with the housing 5 corresponding fastening and clamping elements 60 are available. The implementation of the guide with parallel springs 35 leads to a spring characteristic that is symmetrical in both longitudinal directions of motions with correspondingly more favorable tension curve. Due to the flexing and force relationships in the clamping regions during the forward or backward motion of the machine element the simple spring depicted in FIG. 1 does not have the same spring characteristic. Relative to the zero point, the positive and the negative characteristic of the simple spring are not symmetrical.

In all of the embodiments of guides 8 and 9, it was found to be useful to dispose in each of planes 32, 33, or 51, 52 at least two spring elements 34, implemented to be centrally symmetrical with respect to the central axis 2 and whose axes of orientation, seen in the circumferential direction, intersect at an angle of 90°. If the constructional conditions and the occurring forces require this, the spring elements can however also be disposed at an angle of 60° or 45° with respect to each other. Accordingly, in the region of the oscillatingly moved piston 7 and on housing 5 more fastening and positioning points are provided. Independently of the various possible implementations of the guides these ensure the precise centering of the linearly oscillatingly moved piston along the central axis 2 and a reduction of the deviations from this central axis 2 as a consequence of transverse forces which makes possible minimum gaps between the moved piston and the stationary cylinder liner 4 and therewith contact-free gap seals.

Figure 7:
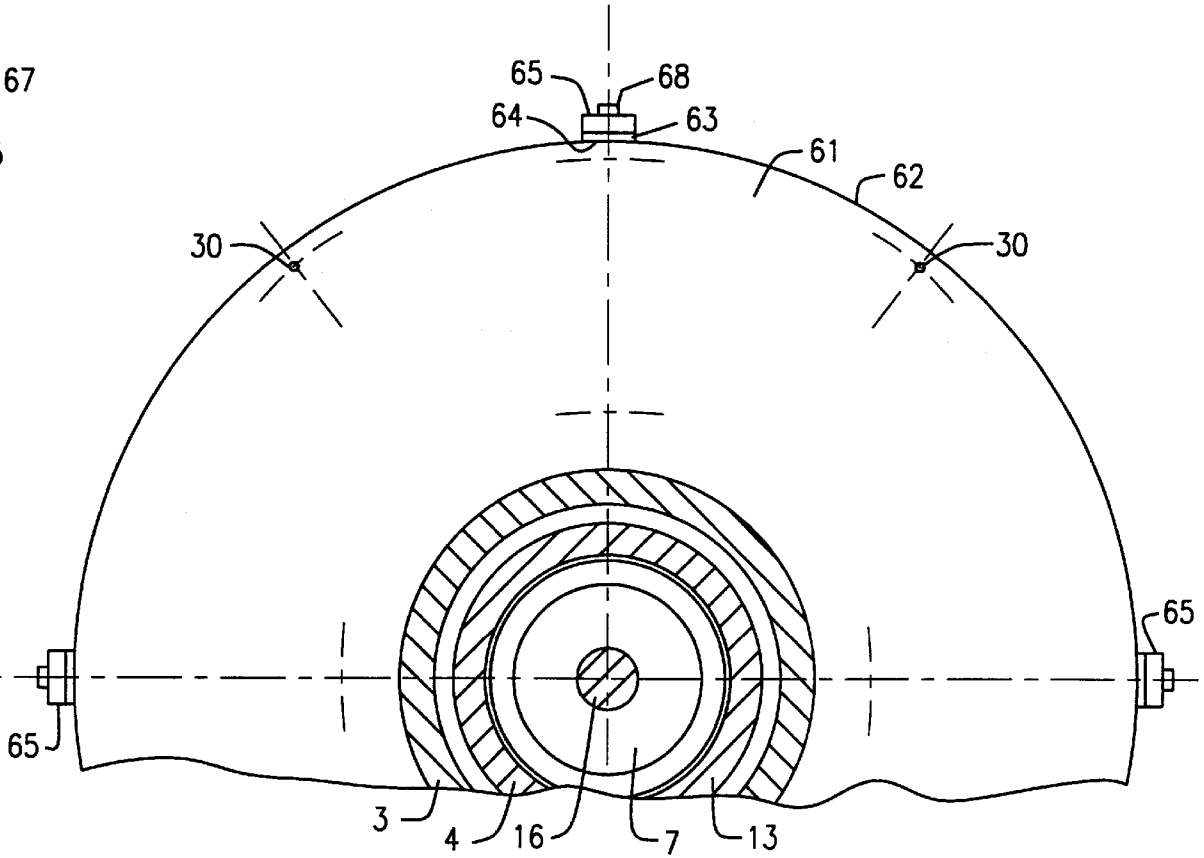
FIG. 7 is a view of the arrangement according to FIG. 6 in the direction of the central axis, with a partial section through cylinder and piston.
Figure 6:
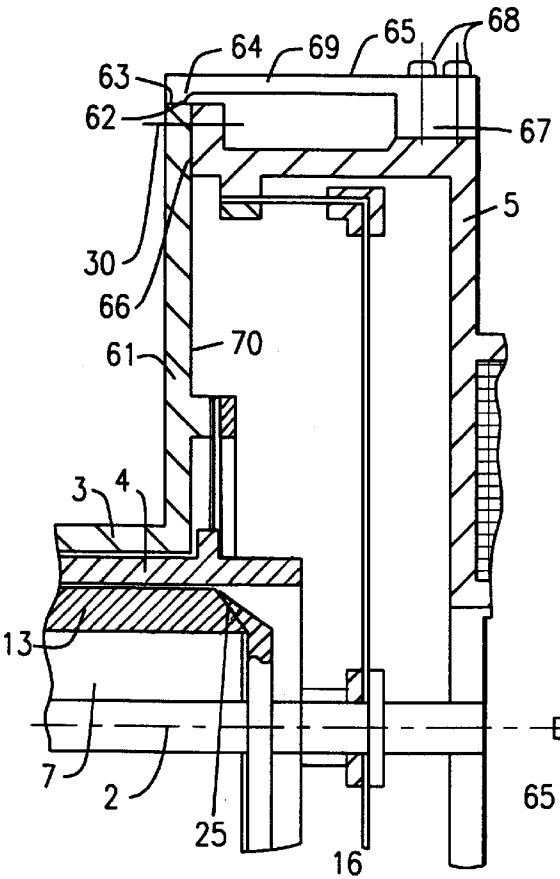
FIG. 6 is a detail from FIG. 1 with elastic mounts for the cylinder on the housing.

FIGS. 6 and 7 show a further advantageous embodiment of the connection between between cylinder 3 and housing 5. The housing part 61 of the cylinder 3 comprises a cylindrical lateral surface 62 implemented precisely centrally to the central axis 2. On housing 5 at least three, in the example shown four, elastic mountings 65 are disposed. These four mountings 65 are each offset radially by 90° and fastened on housing 5 via fastening parts 67 and known fastening means 68, for example screws. Each mounting 65 comprises an elastic tongue 69 on whose free end a mounting face 64 is disposed. Adjoining the mounting face 64 is an oblique guide face 63 diverging toward the outside. On housing 5 furthermore a stop face 66 is disposed which is in a radial plane to the central axis 2 and forms the support and fastening surface for the housing part 61 of cylinder 3. Before assembling the cylinder 3 with housing 5 the mounting faces 64 of the marked mountings 65 are worked so that they delimit an inner diameter which is smaller than the outer diameter of the lateral surface 63 on housing part 61. If the housing part 61 of the cylinder 3 is slid in the direction of the central axis 2 between the mountings 65 the tongues 69 are elastically deformed and between the lateral surface 62 on cylinder 3 and the mounting surfaces 64 on mountings 65 a play-free form fit is formed. The deformation of the elastic tongues 69 on the mountings 65 effect four radial forces of equal magnitude directed toward the central axis 2, which center free of play the housing part 61 and thus the cylinder 3 relative to the central axis 2. In the centered installation position housing part 61 of the cylinder 3 is in contact on the stop face 66 of housing 5 and is connected with the housing 5 by means of known connection elements 30, for example screws. This embodiment of the connections between cylinder 3 and housing 5 ensures the play-free centering and fastening in which the influence of the connection elements 30 on the centricity of the arrangement is avoided. Furthermore, it is also possible to dispose the lateral surface 62 on an annular collar or in a groove on the front face 70 directed toward the housing 5 of the housing part 61. The lateral surface 62 is subsequently realized as an outer surface or as an inner surface. The mountings 65 are disposed accordingly in the inner region of housing 5 and the mounting surfaces 64 on the elastic tongues 69 are directed inwardly or outwardly depending on the orientation of the lateral surface. In the case in which the elastic tongues 69 comprise mounting surfaces 64 disposed on the outside, which engage a collar or a groove on housing part 61 the initial diameter in the nonasssembled condition is greater than the diameter of the lateral surface 62 on housing part 61 of the cylinder 3. The play-free guidance is thereby, as described above, ensured in every embodiment.

I claim:

1. Sealing arrangement on a piston-cylinder unit with a piston (7) longitudinally movable in a cylinder (3) with a cylinder liner (4) in the direction of a central axis (2), with a piston casing (13) and a contact-free gap seal (12) between the cylinder liner (4) and the piston casing (13), for sealing liquid or gaseous medium under excess pressure, wherein the piston-cylinder unit is installed in a housing (5), characterized in that the piston (7) is rigidly connected to two multipart guides (8,9; 50) disposed at a distance to each other in the direction of the central axis (2) and fastened on said housing (5), first long parts (35) of said guides (8,9;50) are movable within limits in the direction of the central axis (2), and elastically guide the piston (7) in the direction of the central axis (2), second short parts (36) of said guides extending substantially parallel to the axis (2), the first parts of said guides (8,9; 50) being at right angles to the central axis (2) and being more rigid by at least a factor of 100 than in the direction of the central axis (2), and maintain the piston (7) precisely centrally to the central axis (2), the piston (7) and the cylinder (3) being composed of several components (13,21,22 or 3,4) and a component forming the cylinder liner (4) and a component forming the piston casing (13) being reciprocally and elastically clamped in centering surfaces (25,28), and relative to the central axis (2) all components of the piston (7) and the cylinder (3) are centered free of radical play, the piston casing (13) and the cylinder liner (4) which oppose each other in regions (14,15) of the gap seal (12) comprise essentially smooth lateral surfaces (14,15), and said regions of the cylinder (3) and the piston (7) are formed of materials which have a linear thermal coefficient of expansion which is smaller at least by a factor of four than that of nonalloyed steel.

2. Sealing arrangement as stated in claim 1, characterized in that the piston casing (13) of the piston (7), which delimits the gap of the gap sealing (12) is formed of sintered graphite without binders and the cylinder liner (4) of the cylinder (3), which delimits this gap, is formed of high-nickel steel which is an alloy of iron and nickel only.

3. Sealing arrangement as stated in claim 1 characterized in that the piston casing (44) of the piston (7) and the cylinder liner (4) which delimits the gap of the gap seal (12) are formed of high-nickel steel which is an alloy of iron and nickel only, and on the piston casing (44) the surface (14) directed toward this gap is coated with a nickel-graphite coating which has no further additive.

4. Sealing arrangement as stated in claim 1, characterized in that the piston (7), cylinder (3) and guides (8, 9; 50) are parts of a Stirling free-piston motor.

5. Sealing arrangement as stated in claim 1, characterized in that the piston (7), cylinder (3) and guides (8, 9; 50) are parts of a compressor (1) with linearly oscillating drive (10, 11).

6. Sealing arrangement on a piston-cylinder unit with a piston (7) longitudinally movable in a cylinder (3) with a cylinder liner (4) in the direction of a central axis (2), with a piston casing (13) and a contact-free gap seal (12) between the cylinder liner (4) and the piston casing (13), for sealing liquid or gaseous medium under excess pressure, wherein the piston-cylinder unit is installed in a housing (5), characterized in that the piston (7) is rigidly connected to two guides (8,9; 50) disposed at a distance to each other in the direction of the central axis (2) and fastened on housing (5), parts (35) of said guides (8,9;50) are movable within limits in the direction of the central axis (2), and elastically guide the piston (7) in the direction of the central axis (2), the guides (8,9; 50) being at right angles to the central axis (2) and being more rigid by at least a factor of 100 than in the direction of the central axis (2), and maintain the piston (7) precisely centrally to the central axis (2), the piston casing (13) and the cylinder liner (4) which oppose each other in the regions of the gap seal (12) comprise essentially smooth lateral surfaces (14,15), and said regions of the cylinder (3) and the piston (7) are formed of materials which have a linear thermal coefficient of expansion which is smaller at least by a factor of four than that of nonalloyed steel, the arrangement including a housing part (61) of the cylinder (3) being clamped opposite to the housing (5) in a conical centering surface (29) or said housing part (61) is guided via a lateral surface (62) by means of at least three elastic mountings fastened on the housing (5) so as to be free of play and clamped with connection elements (30) clamped axially against a stop face (66) of the housing (5), and the housing part (61), and consequently the cylinder (3), is centered free of play relative to the central axis (2).

7. Sealing arrangement on a piston-cylinder unit with a piston (7) longitudinally movable in a cylinder (3) with a cylinder liner (4) in the direction of a central axis (2), with a piston casing (13) and a contact-free gap seal (12) between the cylinder liner (4) and the piston casing (13), for sealing liquid or gaseous medium under excess pressure, wherein the piston-cylinder unit is installed in a housing (5), characterized in that the piston (7) is rigidly connected to two guides (8,9; 50) disposed at a distance to each other in the direction of the central axis (2) and fastened on housing (5), parts (35) of said guides (8,9;50) are movable within limits in the direction of the central axis (2), and elastically guide the piston (7) in the direction of the central axis (2), the guides (8,9; 50) being at right angles to the central axis (2) and being more rigid by at least a factor of 100 than in the direction of the central axis (2), and maintain the piston (7) precisely centrally to the central axis (2), the piston casing (13) and the cylinder liner (4) which oppose each other in the regions of the gap seat (12) comprise essentially smooth lateral surfaces (14,15), and said regions of the cylinder (3) and the piston (7) are formed of materials which have a linear thermal coefficient of expansion which is smaller at least by a factor of four than that of nonalloyed steel, each of the two guides (8,9; 50) comprising several plate-form spring elements (34) which are disposed in a plane (32, 33; 51, 52) extending at approximately right angles to the central axis (2) of the piston (7), each spring element (34) is securely connected, at one end to the piston in the region of the central axis (2) and connected to the housing, in the region of outer ends of the spring elements (34); each of the spring elements (34) comprises at least one long main spring part (35), which extends in the plane (32,33; 51,52) at right angles to the central axis (2), and on each end directly toward the housing (5) at least one short auxiliary spring part (36) which is disposed approximately parallel to the central axis (2), between each auxiliary spring part (36) and the associated main spring part (35) a connection element (38) is disposed, and the auxiliary spring parts (36) via these connection elements (38) are rigidly connected with the outer ends (37) of the main spring parts (35).

8. Sealing arrangement as stated in patent claim 7, characterized in that each of the two guides (8, 9; 50) comprises at least two centrally symmetrical spring elements (34) which are disposed in a plane (32, 33; 51, 52) at right angles to the central axis (2) of the piston (7), and radially intersect this central axis (2) wherein between the spring elements (34), seen in the circumferential direction, in each instance identical angles are formed.

9. Sealing arrangement as stated in patent claim 7, characterized in that at least one of the guides (8, 9; 50) comprises two planes (51, 52) with spring elements (34), wherein these planes (51, 52) extend parallel and in the direction of the central axis (2) spaced at a distance to each other, as well as at right angles to the central axis (2).

10. Sealing arrangement as stated in patent claim 7, characterized in that each of the spring elements (34) comprises an integral or multi-piece main spring part (35) and two pairs of parallel auxiliary spring parts (36).

11. Sealing arrangement as stated in patent claim 7, characterized in that each of the spring elements (34) comprises a pair of integral or multi-piece main spring parts (35) disposed in parallel and two pairs of parallel auxiliary spring parts (36).

12. Sealing arrangement on a piston-cylinder unit with a piston (7) longitudinally movable in a cylinder (3) with a cylinder liner (4) in the direction of a central axis (2), with a piston casing (13) and a contact-free gap seal (12) between the cylinder liner (4) and the piston casing (13), for sealing liquid or gaseous medium under excess pressure, wherein the piston-cylinder unit is installed in a housing (5), characterized in that the piston (7) is rigidly connected to two guides (8,9; 50) disposed at a distance to each other in the direction of the central axis (2) and fastened on housing (5), parts (35) of said guides (8,9;50) are movable within limits in the direction of the central axis (2), and elastically guide the piston (7) in the direction of the central axis (2), the guides (8,9; 50) being at right angles to the central axis (2) and being more rigid by at least a factor of 100 than in the direction of the central axis (2), and maintain the piston (7) precisely centrally to the central axis (2), the piston casing (13) and the cylinder liner (4) which oppose each other in the regions of the gap seal (12) comprise essentially smooth lateral surfaces (14,15), and said regions of the cylinder (3) and or the piston (7) are formed of materials which have a linear thermal coefficient of expansion which is smaller at least by the a factor of four than that of nonalloyed steel, said piston (7) comprising a piston rod (6) having a conical centering surface (25) engaged against said piston casing (13), said cylinder lining (4) being engaged against said cylinder (3) at a further conical centering surface (28), a first elastic clamping element (23) connected to said piston for engaging said conical centering surfaces of said piston casing and said piston rod against each other, and a second elastic clamping element (26) connected to said housing for engaging the further conical centering surfaces of said cylinder and said cylinder liner against each other.

* * * * *